US005476071A

United States Patent [19]

Nishiyama et al.

[11] Patent Number: 5,476,071

[45] Date of Patent: Dec. 19, 1995

[54] PRESSURIZED FLUIDIZED BED BOILER

[75] Inventors: Akio Nishiyama; Masataka Ogasawara; Kenji Higashikawa; Kimihiro Nonaka; Taro Sakata, all of Kure, Japan

[73] Assignee: Babcock-Hitachi Kabushiki Kaisha, Japan

[21] Appl. No.: 286,321

[22] Filed: Aug. 4, 1994

[51] Int. Cl.[6] ..... F22B 1/00

[52] U.S. Cl. ..... 122/4 D; 110/245; 165/104.16; 422/146; 60/39.464

[58] Field of Search ..... 122/4 D; 110/245; 165/104.16; 422/146; 60/39.464

[56] References Cited

FOREIGN PATENT DOCUMENTS 156201 11/1989 Japan .

OTHER PUBLICATIONS

Proc. 1989 Int. Conf. on Fluidized Bed Combustion vol. 1, pp. 203–209.

Proc. 1989 Int. Conf. on Fluidized Bed Combustion vol. 1, pp. 211–231.

*Primary Examiner*—Henry A. Bennet
*Assistant Examiner*—Siddharth Ohri
*Attorney, Agent, or Firm*—Lorusso & Loud

[57] ABSTRACT

In a pressurized fluidized bed boiler, furnace means is divided into at least two separate furnaces: a furnace with an evaporator and a superheater disposed therethrough, and a furnace with the superheater and a reheater disposed therethrough. The furnaces are accommodated in separate pressure vessels, respectively. Air is supplied into the pressure vessels through air pipes connected to the pressure vessels, where it is used for pressurizing the pressure vessels, and then supplied into the furnaces through their lower portions, where it is used as a combustion air. An oxygen concentration meter is mounted in an exhaust gas pipe in an outlet of the furnace, and an air flow rate adjusting valve 3 is mounted outside each of the pressure vessels. Thus, a more precise control of air-fuel ratio can be performed independently for every furnaces by controlling the air flow rate adjusting valves on the basis of at least one of an oxygen concentration signal from the oxygen concentration meter and a fuel supply amount signal from a fuel supply pump motor.

10 Claims, 5 Drawing Sheets

PRESSURIZED FLUIDIZED BED BOILER

BACKGROUND OF THE INVENTION

1. Field of the Invention

The present invention relates to a steam generator, and particularly, to a pressurized fluidized bed boiler including control means capable of performing excellent controls of steam temperature and air-fuel ratio.

2. Description of the Prior Art

D. Bunthoff and others have published "PRESSURIZED FLUIDIZED BED COMBUSTION AND FIRST EXPERIENCE WITH THE BABCOCK 15 MWth PFEBC PILOT PLANT" 1989, INTERNATIONAL CONFERENCE ON FLUIDIZED BED COMBUSTION, Vol.1, 219 pp, which is one example of prior art pressurized fluidized bed boilers including a furnace disposed within a pressure vessel and having a structure in which a lower portion thereof, specifically, an area with an in-bed heat-transfer tube disposed therein, is divided into two zones, and gases are joined to each other at an upper area of the furnace From the above International Conference Report, a construction is easily conceived which is different from the example in the above International Conference Report and which comprises an evaporator tube 8 and a portion 9*a* of a superheater tube 9 disposed as heat transfer tubes in one zone 1*a* of a furnace, and a reheater tube 10 and the other portion of the superheater tube 9 disposed on the other zone 1*b* of the furnace, as shown in FIG. 3. In the example shown in FIG. 3, the temperature of steam in an outlet of the superheater 9 is controlled by permitting a bed material within the furnace zone 1*a* to flow into and out of a tank 7*a* to vary the level of the bed. The temperature of steam in an outlet of the reheater 10 is also controlled by permitting the bed [material within the other furnace zone 1*b* to flow into and out of a tank 7*b* to vary the level of the bed. Thus, a reduction in efficiency of the plant is prevented without use of a reheater spray. The reheater spray may be used in an emergency when the temperature of steam in the outlet of the reheater has been abnormally risen.

Combustion exhaust gases resulting from combustion in the furnace zones 1*a* and 1*b* are joined to each other at their upper portions and supplied via an exhaust gas duct 13 into a gas turbine 15. Air within an air duct 4 is compressed by an air compressor 16 driven by the gas turbine 15 and supplied into a pressure vessel 2. An exhaust gas discharged from the gas turbine 15 is cooled in an exhaust gas cooler 17 and then released through a stack 18 into the atmosphere.

In the example shown in FIG. 3, the bed levels of the furnace zones 1*a* and 1*b* are governed by the temperatures of steams in the outlets of the superheater 9 and the reheater 10, and hence, they are necessarily not equal to each other and are largely different from each other depending upon operational conditions of the plant such as the stopping and the starting of the plant or a variation in load of the plant. Therefore, in order to maintain a proper fluidizing speed and a proper air-fuel ratio required to maintain a good combustion in both the furnace zones 1*a* and 1*b*, an adjusting valve for constantly monitoring and adjusting the flow rate of air supplied into the furnace zones 1*a* and 1*b* is required. In this case, however, as shown in FIG. 3, air flow rate adjusting valves 3*a* and 3*b* in combustion air ducts 4*a* and 4*b* must be placed in the pressure vessel 2, resulting in a problem arisen in the reliability and maintenance of the air flow rate adjusting valves 3*a* and 3*b*.

Further, it is impossible to independently measure the oxygen concentrations in outlets of fluidized beds in the furnace zones 1*a* and 1*b*, resulting in a problem arisen even in the control of the air-fuel ratio.

Thereupon, an example is shown in FIG. 4, in which the entire furnace arrangement is divided in order to solve the above problems (see Japanese Patent Application Laid-open No. 156201/91). In the example shown in FIG. 4, the furnace arrangement 1 accommodated in a single pressure vessel 2 is completely divided into two furnaces 1*a* and 1*b*. This ensures that the oxygen concentration in exhaust gas outlets of the furnaces 1*a* and 1*b* can be monitored, thereby enabling a reliable control of the air-fuel ratio. In the prior art technique shown in FIG. 4, however, in the respect of independent control of the flow rates of air in the furnaces 1*a* and 1*b*, an approach is not taken into consideration, thereby leaving the same problem as in the prior art technique shown in FIG. 3. Of course, it is possible to independently control the flow rates for each of the furnaces 1*a* and 1*b*, but for the same reason as in the example shown in FIG. 3, the problem is left in the respect of the reliability of maintenance of the air flow rate adjusting valves.

It is also conceived to place air tubes 4*a* and 4*b* to extend from the outside of a pressure vessel 2 directly into divided furnace portions 1*a* and 1*b* within a pressure vessel 2. When this construction is employed, a compressed air source is additionally required for pressurizing the interior of the pressure vessel 2. An air tube system 19 may be mounted for the compressed air source to extend from an air compressor 16 and measurement-control attachments (a valve 20 and the like) may be mounted in the air tube system 19, thereby bringing about a complication in entire plant and an increase in cost. In addition, after the interior of the pressure vessel 2 has been once pressurized the compressed air used therefor is not required and hence, the valve 20 is closed to stop the supply of the air. Consequently, the air in the pressure vessel 2 may be stagnated and subjected to a radiant heat from the furnaces 1*a* and 1*b*, so that the temperature of the atmosphere within the pressure vessel 2 is gradually risen. Therefore, the design temperatures of the pressure vessel 2 and the structures within the pressure vessel 2 must be risen and thus, it is required to increase the all thickness of a material or to increase the grade of the material, thereby bringing about an increase in cost.

SUMMARY OF THE INVENTION

Accordingly, it is an object of the present invention to provide a pressurized fluidized bed boiler apparatus which is excellent in reliability and maintenance. And it is another object of the present invention to provide a pressurized fluidized bed boiler apparatus which includes a simple and inexpensive air flow rate control mechanism also serving to pressurize the interior of the pressure vessel. It is an object of the present invention to provide a pressurized fluidized bed boiler apparatus which is capable of performing a good control of air-fuel ratio.

To achieve the above object, according to the present invention, there is provided a pressurized fluidized bed boiler comprising furnace means having an evaporator, a superheater and reheater disposed therein and divided into at least two separate furnaces: a furnace with an evaporator disposed therethrough, and a furnace with a reheater disposed therethrough, at least two pressure vessels which separately accommodate the furnaces, respectively, control means for controlling the temperature of steam in outlets of the superheater and the reheater by varying the level of the fluidized bed in each of the separate furnaces, and air tubes connected to the pressure vessels to introduce a combustion air into the furnaces and a compressed air into the pressure vessels.

To achieve the above object, according to the present invention, there is also provided a pressurized fluidized bed boiler comprising furnace means having an evaporator, a superheater and reheater disposed therein and divided into at least two separate furnaces: a furnace with an evaporator disposed therethrough, and a furnace with a reheater disposed therethrough, at least two pressure vessels which separately accommodate the furnaces, respectively, control means for controlling the temperature of steam in each of outlets of the superheater and the reheater by varying the level of the fluidized bed in each of the separate furnaces, air tubes connected to the pressure vessels to introduce a combustion air into said furnaces and a compressed air into said pressure vessels, respectively, air flow rate adjusting means mounted in said air tubes connected to said pressure vessels for independently controlling the flow rate of air introduced into each of said furnaces, oxygen concentration detecting means mounted in an exhaust gas tube from each of said furnaces for detecting the concentration of oxygen in an exhaust gas in an outlet of each of said furnaces, fuel supply amount detecting means for detecting the amount of fuel supplied into each of said furnaces, and air-fuel ratio control means for allowing said air flow rate adjusting means to perform an air flow rate control on the basis of a detection value detected by at least one of said oxygen concentration detecting means and said fuel supply amount detecting means.

The said furnace means may be divided into three or more furnaces, including a furnace with the evaporator being disposed to extend therethrough, and a furnace with the reheater means divided into two or more reheaters being disposed therein to extend therethrough.

And the said superheaters may be separately disposed in said furnace with said evaporator disposed therein and in said furnace with said reheater disposed therein.

The pressure vessels may be sized so that the diameter ratio of the pressure vessel having largest diameter and the vessel having the smallest diameter is in a range of from 1:1 to 1:1.2. Preferably, each of the furnaces is sized and shaped so that it can be accommodated in the corresponding pressure vessel.

The present invention also includes a pressurized fluidized bed boiler, wherein only said furnace having the evaporator disposed therein is started at an initial stage of starting of said boiler, and said furnace having the reheater disposed therein is started only when a condition permitting steam to be sufficiently insured in said reheater has been reached.

With the above construction since the air flow rate adjusting valves for adjusting the flow rates of air into the furnaces are placed outside the pressure vessels, respectively, there is no problem in the reliability and maintenance of each of the adjusting valves. The combustion air to be supplied to the furnaces, after being passed through the pressure vessels, is permitted to flow into the furnaces and therefore, an equipment for pressurizing the pressure vessel is not required. In addition, since such air is always flowing, the temperature cannot be risen by a radiant heat from the furnace.

Further, the air flow rate adjusting means connected to the pressure vessels is controlled by the signal supplied from the air-fuel ratio control means which has received both or either one of the signal indicative of the concentration of oxygen in the exhaust gas in the exhaust gas tube at the outlet of the furnace and the signal indicative of the amount of fuel supplied into the furnace, thereby controlling the flow rate of the combustion air to a proper value in each furnace.

Even when a variation in temperature of steam is produced, or even when the temperatures at the outlets of the superheater and the reheater are largely unbalanced, the temperature of steam can be controlled by adjusting the level of the fluidized bed of each furnace without a fear of a reduction in performance of the boiler due to an unbalance in air-fuel ratio. This leads to an increased control scope for the steam temperature over the prior art.

Additionally, since the reheater and the evaporator are separately accommodated in the separate furnaces, respectively, a firing damage of a heat transfer tube of the reheater can be prevented by starting the furnace accommodating the evaporator rather than the furnace accommodating the reheater at an initial stage of the start of the boiler before supplying of a gas into a steam turbine, and then starting the furnace accommodating the reheater after sufficient insuring a cooled steam in the reheater.

The above and other objects features and advantages of the invention will become apparent from a consideration of the following description of the preferred embodiments taken in conjunction with the accompanying drawings.

DESCRIPTION OF THE PREFERRED EMBODIMENTS

The present invention will now be described by way of preferred embodiments in connection with the accompanying drawings.

First, a first embodiment of a pressurized fluidized bed boiler will be described.

Figure 1:
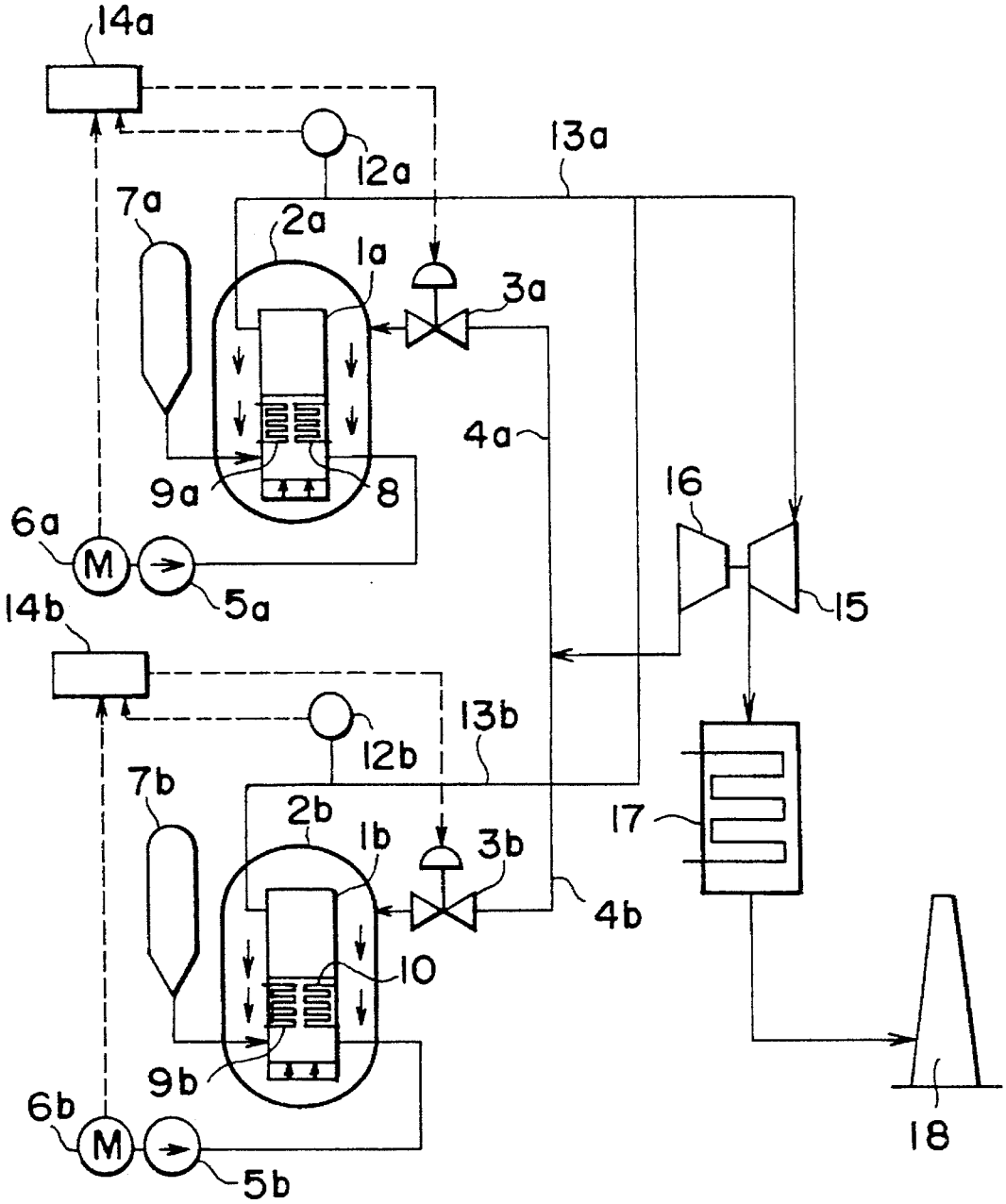
FIG. 1 is an illustration of the entire system using a pressurized fluidized bed boiler according to a first embodiment of the present invention.

Referring to FIG. 1, two furnaces 1*a* and 1*b* are accommodated in pressure vessels 2*a* and 2*b*, respectively. Air is supplied through air flow rate adjusting valves 3*a* and 3*b* via air ducts 4*a* and 4*b* into the furnaces 1*a* and 1*b*, respectively. A fuel is supplied from fuel supply pumps 5*a* and 5*b* driven by an electric pump-driving motors 6*a* and 6*b* into the furnaces 1*a* and 1*b*, respectively. The level of a bed in each of the furnaces 1*a* and 1*b* can be varied by permitting a bed material of the furnace 1*a*, 1*b* to flow into and out of corresponding one of tanks 7*a* and 7*b*.

An evaporator 8 and a portion 9*a* of a superheater 9 are disposed in the furnace 1*a* to extend therethrough, and a reheater 10 and the remaining portion 9*b* of the superheater 9 are disposed in the furnace 1*b* to extend therethrough. As a result of the superheater 9 being disposed in a divided manner, the furnaces 1*a* and 1*b* are formed at the same size.

The reheater 10 does not extend into the furnace 1*a* accommodating the evaporator 8. The temperature of steam in an outlet of the superheater 9 is controlled by permitting the bed material in the bed within the furnace 1*a* to flow into and out of the tank 7*a*, and the temperature of steam in an outlet of the reheater 10 is controlled by permitting the bed material in the bed within the furnace 1*b* to flow into and out of the tank 7*b* by well known conventional method not shown in the figure. Thus, a reheater spray is not required.

Combustion exhaust gases resulting from the combustion in the furnaces 1*a* and 1*b* are passed through exhaust gas ducts 13*a* and 13*b*, joined to each other at a junction between the exhaust gas ducts 13*a* and 13*b* and then supplied to a gas turbine 15. Air in the air ducts 4*a* and 4*b* is compressed by an air compressor 16 driven by the gas turbine 15. The compressed air is supplied through the air ducts 4*a* and 4*b* into the pressure vessels 2*a* and 2*b*. The compressed air supplied into the pressure vessels 2*a* and 2*b* is introduced into the furnaces 1*a* and 1*b* through lower portions thereof and used as a combustion air therein. In this manner, the air in the pressure vessels 2*a* and 2*b* is always flowing during operation of the boiler and hence, the atmosphere within each of the pressure vessels 2*a* and 2*b* cannot be excessively heated.

An exhaust gas discharged from the gas turbine 15, after being cooled by an exhaust gas cooler 17, is released through a stack 18 into the atmosphere.

The construction of control means for controlling the operation of the boiler of this embodiment rill be described below.

Oxygen concentration meters 12*a* and 12*b* are mounted in the exhaust gas ducts 13*a* and 13*b* for measuring the concentrations of oxygen in the exhaust gases discharged from the furnaces 1*a* and 1*b*, respectively. Current value signals from the electric pump-driving motors 6*a* and 6*b*, oxygen concentration signals from the oxygen concentration meters 12*a* and 12*b* and air flow rate signals from the air flow rate adjusting valves 3*a* and 3*b* can be transmitted to control units 14*a* and 14*b* associated with the pressure vessels 2*a* and 2*b*, respectively.

In each of the control units 14*a* and 14*b*, an air flow rate required for an operation at a preset air-fuel ratio is calculated in accordance with a fuel supply amount calculated from the current value signal from the electric pump-driving motor 6*a*, 6*b*, and the opening degree of the air flow rate adjusting valve 3*a*, 3*b* required for this air flow rate is calculated, thereby controlling the air flow rate. Alternatively, in each of the control units 14*a* and 14*b*, an air flow rate in each of the furnaces 1*a* and 1*b* may be calculated on the basis of the oxygen concentration signal from the oxygen concentration meter 12*a*, 12*b*, so that the concentration of oxygen in the outlet of the pressure vessel is always equal to a preset value, and the opening degree of the air flow rate adjusting valve 3*a*, 3*b* may be calculated, thereby controlling the air flow rate to provide a proper air-fuel ratio, i.e., a proper concentration of oxygen in the outlet of the furnace.

If the opening degree of each of the air flow rate adjusting valves 3*a* and 3*b* is calculated on the basis of both of the current value signal from the corresponding electric pump-driving motor 6*a*, 6*b* and the oxygen concentration signal from the corresponding oxygen concentration meter 12*a*, 12*b*, the air flow rate can be controlled to provide a more proper air-fuel ratio.

In order to maintain a proper combustion in the fluidized bed or to prevent the heat transfer pipe from being worn, it is necessary to operate the boiler at a gas flow speed in the fluidized bed in a range of about 0.8 to 1.2 m/sec. The control of the flow speed is carried out by controlling the pressure in the furnace 1*a*, 1*b* in accordance with a variation in air flow rate, so that the flow speed is equal to a value in such range.

Since the reheater 10 and the evaporator 8 are separately accommodated in the separate furnaces 1*a* and 1*b*, respectively, a firing damage of the heat transfer pipe is prevented at an initial stage of the starting of the boiler and before supplying of the gas into the steam turbine.

It should be noted that superheated steam and reheated steam produced in the furnaces 1*a* and 1*b* are supplied through pipes (not shown) to a required load device.

Figure 2:
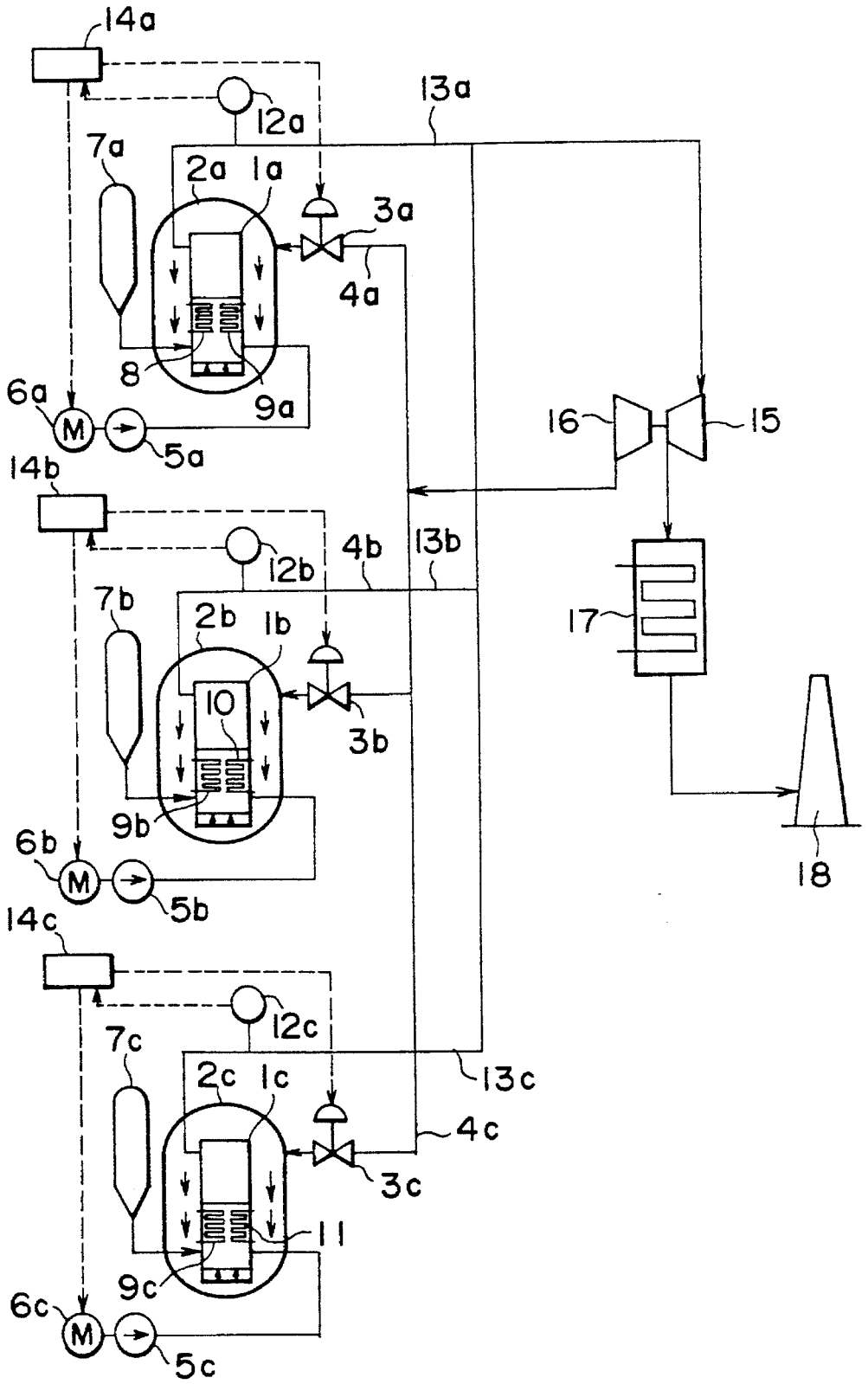
FIG. 2 is an illustration of the entire system using a pressurized fluidized bed boiler according to a second embodiment of the present invention.
Figure 3:
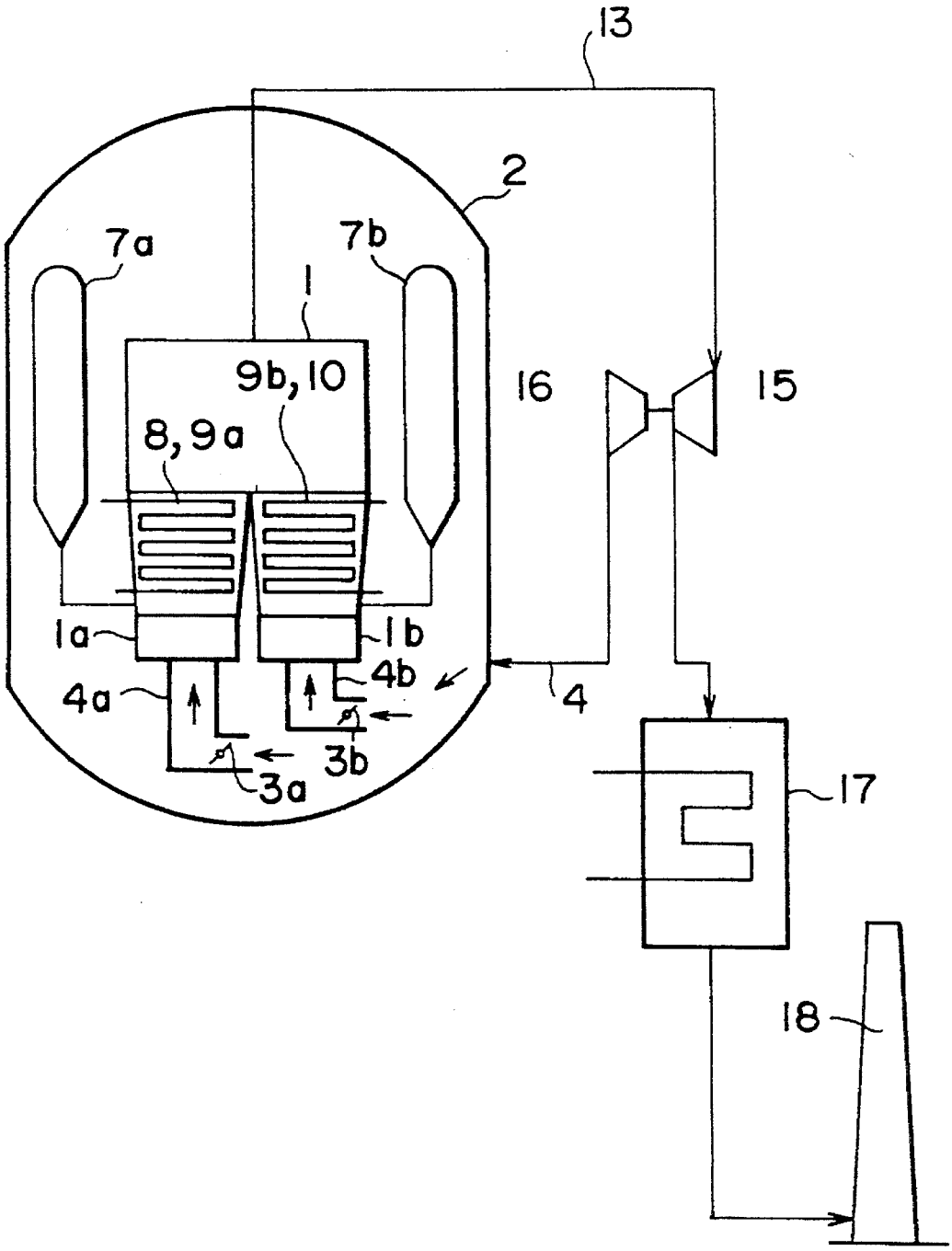
FIG. 3 PRIOR ART
FIG. 3 is an illustration of the entire system using a prior art pressurized fluidized bed boiler with a fluidized bed of a furnace being divided into two zones.
Figure 4:
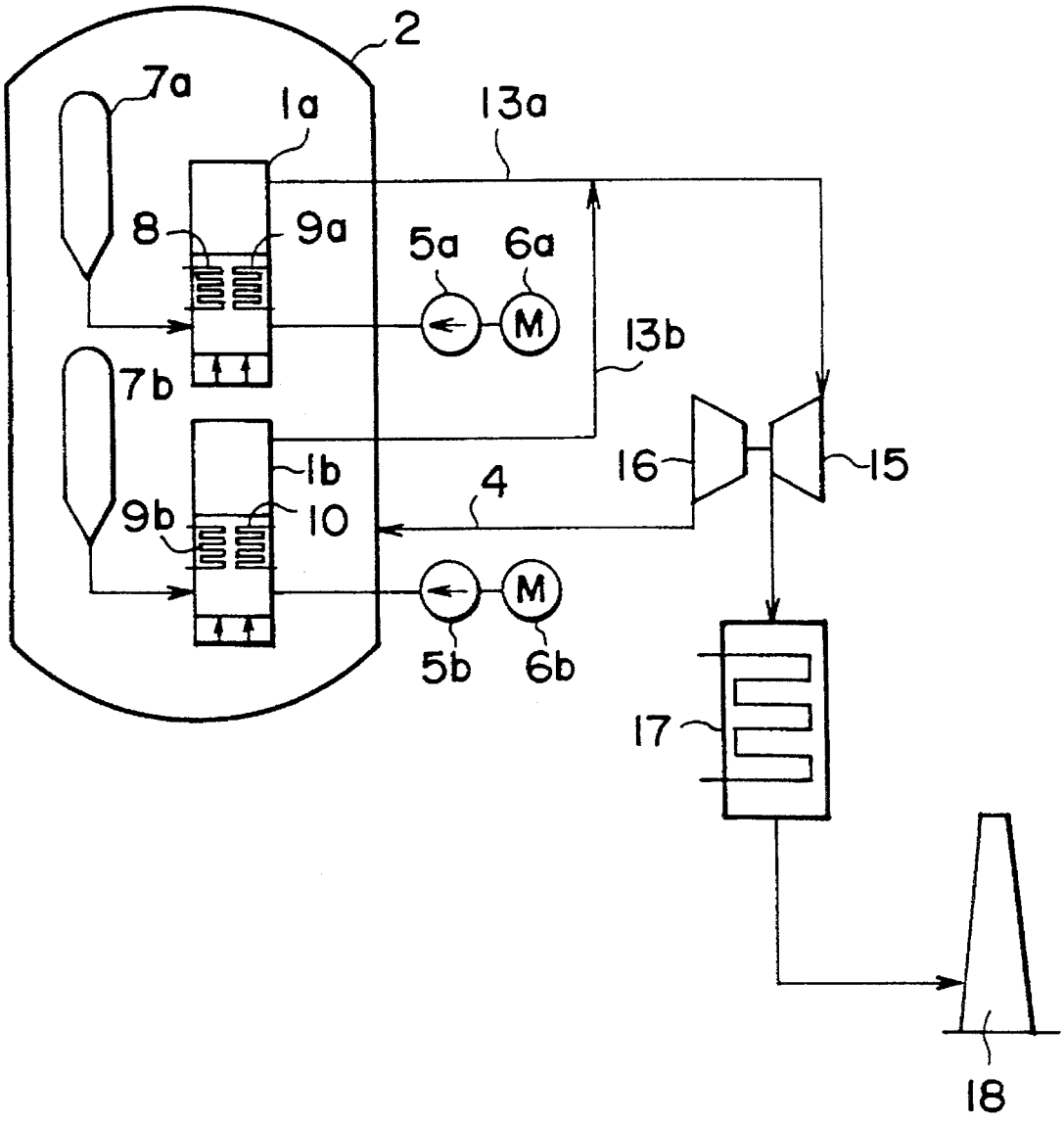
FIG. 4 PRIOR ART
FIG. 4 is an illustration of the entire system using a prior art pressurized fluidized bed boiler with a furnace arrangement being divided into two furnaces.
Figure 5:
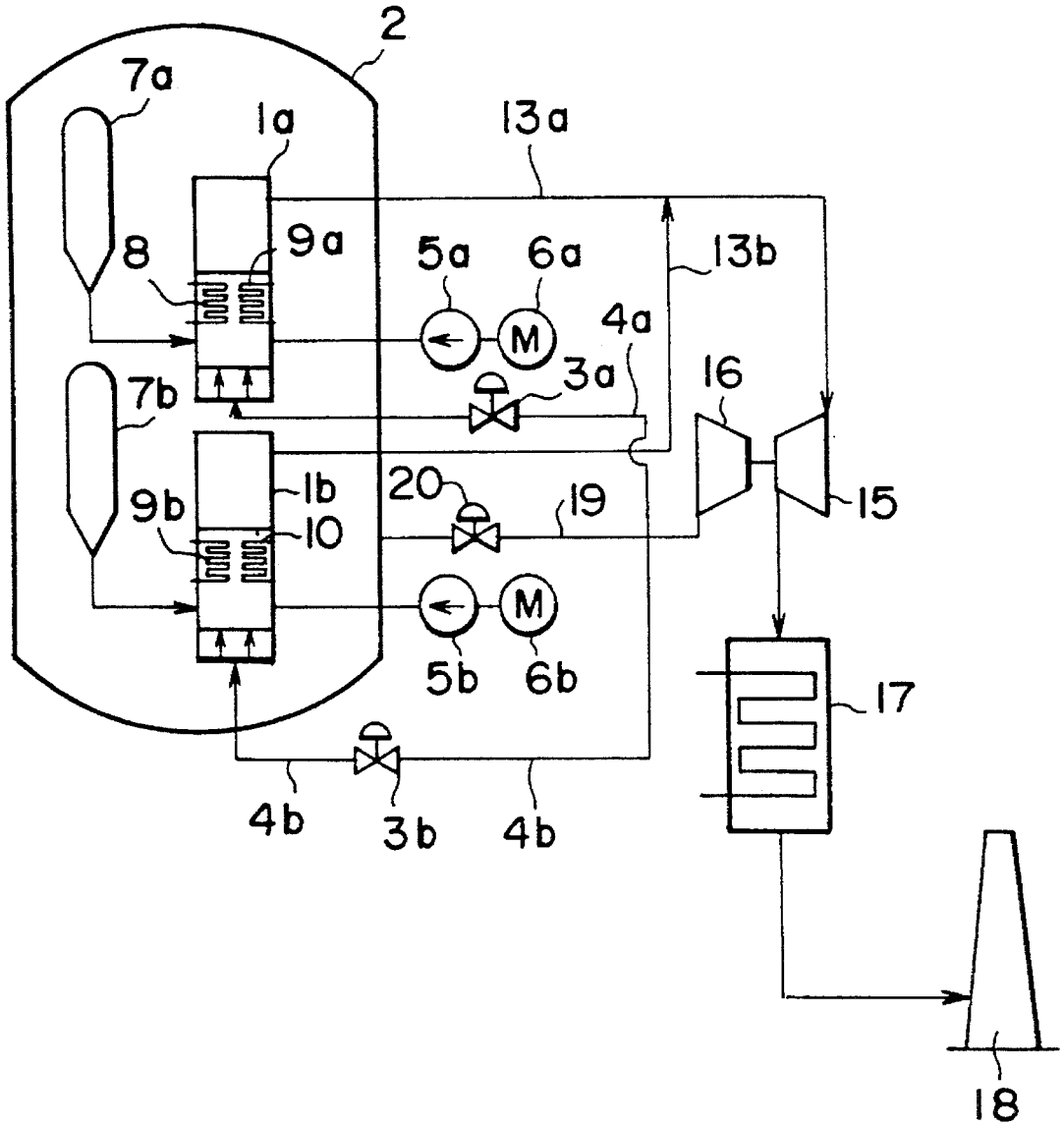
FIG. 5 PRIOR ART
FIG. 5 is an illustration of the entire system using a prior art pressurized fluidized bed boiler with an air tube connected directly to furnaces.

Referring to FIG. 2, a second embodiment of a pressurized fluidized bed boiler is shown. This boiler employs a two-stage reheating system to provide an enhanced efficiency of a plant. In this case, it is necessary to independently control the team temperatures at three points: an outlet of a superheater, an outlet of a first-stage reheater and an outlet of a second-stage reheater. Thereupon, as shown in FIG. 2, a furnace means is divided into three furnaces: a first furnace 1*a* used for controlling the temperature of steam in the outlet of the superheater 9*a*, a second furnace 1*b* used for controlling the temperature of steam in the outlet of the first-stage reheater 10, and a third furnace 1*c* used for controlling the temperature of steam in the outlet of the second-stage reheater 11. In this case, the superheater means 9 is disposed in a divided manner in the furnaces 1*a*, 1*b* and 1*c*, so that the three furnaces 1*a*, 1*b* and 1*c* are of the same size.

As shown in FIG. 2, the three furnaces, into which the furnace means 1 is divided, are independently accommodated in pressure vessels 2*a*, 2*b* and 2*c*. In this case, the superheater means 9 is divided into three portions, and the reheater means is divided into two portions. More specifically, the evaporator 8 and the superheater 9*a* are disposed in the furnace 1*a* to extend therethrough; the superheater 9*b* and the first-stage reheater 10 are disposed in the furnace 1*b* to extend therethrough, and the superheater 9*c* and the second-stage reheater 11 are disposed in the furnace 1*c* to extend therethrough.

The equipments associated with the furnaces 1*a*, 1*b* and 1*c* are similar to those in the first embodiment and hence, the description of them is omitted. However, it should be appreciated that a control means 14 is divided into control units because of the need for independently controlling the steam temperatures at the three points: the outlet of the superheater 9*a*, the outlet of the first-stage reheater 10 and the outlet of the second-stage reheater 11, as described above. The control means 14 may be, of course, comprised of a single control unit arranged to control the three furnaces 1*a*, 1*b* and 1*c*. Exhaust gases from the furnaces 1*a*, 1*b* and 1*c* are jointed together and supplied to the gas turbine 15.

Since the first-stage reheater 10 and the second-stage reheater 11 are disposed respectively in the furnaces 1*b* and 1*c* other than the furnace 1*a* accommodating the evaporator 8, it is possible to prevent a firing damage of the heat transfer pipes of the heaters 10 and 11 at the initial stage of starting of the boiler before supplying of the gas into the turbine, as described above.

With the above-described embodiments of the present invention, following effects are provided:

First, since the air adjusting valve means 3 for controlling the flow rate of air into the furnace means 1 is disposed outside the pressure vessel 2, an air adjusting valve excellent in reliability and maintenance can be provided. In addition, since the combustion air, after being passed through the pressure vessel 2, is permitted to flow into the furnace means 1, an air equipment only used for pressurizing the pressure vessel 2 is not required, leading to a simplified apparatus. Because the air in the pressure vessel 2 is always flowing, the temperature cannot be risen by a radiant heat from the furnace means 1, and the design temperature of the devices within the pressure vessel 2 as well as the pressure vessel 2 itself can be reduced lower than that of the prior art, leading to a reduction in material cost.

Further, since the separate oxygen concentration meters are included in the exhaust gas outlets of the furnaces, respectively, and the opening degree of the air control valve 3 is controlled to provide a proper flow rate of combustion air by both or either one of the signals indicative of the measurement values determined in the meters and the signal indicative of the amount of fuel supplied, the boiler is excellent in reliability of the control of the air-fuel ratio.

When a variety of practical operations of the plant are supposed, such as when a difference between steam temperatures is produced even in a normal operation, the bed levels within the furnaces are necessarily not equal to one another, resulting in a possibility that system losses are unbalanced between the furnaces. When there is a trouble such as a clogging of an air dispersing plate (not shown) mounted within the furnace, the system losses are unbalanced. This causes the flow rates of combustion air to be often unbalanced. However, with the embodiments of the present invention, fuel flow rate or the flow rate of combustion air is controlled even in such cases by the signals indicative of the oxygen concentrations in the exhaust gas outlets of the furnaces and therefore, an operation can be carried out at a constantly proper air-fuel ratio.

The conventional method of controlling the air-fuel ratio can be used in which even when the nature of the fuel is varied, or an error of the air flow rate is produced, this variation or error is detected by the oxygen concentration meters mounted in the exhaust gas outlets of the furnaces. Therefore, an operation at a highly reliable can be maintained, and thus, good conditions for combustion in the furnaces can be always maintained. This provides effects for maintaining the plant efficiency, insuring the environmental performance, and preventing a reduction in wall thickness of the heat transfer pipe due to a reducing corrosion.

Therefore, even when the temperatures of steam is varied, or even when the temperature in the outlets of the superheater means 9 and the reheater 10 (the first embodiment) as well as in some cases, the two-stage reheaters 10 and 11 (the second embodiment), are unbalanced largely, the temperatures of steam can be controlled by adjusting the level of the fluidized bed in each of the furnaces without a fear of a reduction in performance of the boiler due to an unbalance in the air-fuel ratio, leading to a further largely increased scope of the control of the steep temperature over the prior art.

In the above-described embodiments, by the fact that the furnace with the reheater 10 provided therein is separated from the furnace with the evaporator 8 provided therein, the heat transfer pipe of the reheater 10 can be prevented from being damaged by firing at the initial stage of the starting of the boiler before supplying of the gas to the turbine, and moreover, the starting can be achieved in a short time, leading to a saving of the fuel for the starting and a reduction in power generation loss at the stoppage of the starting. The ability to stagger the starting timings for every furnaces is an effect provided by enabling the control of the air flow rates for every furnaces.

In addition, the diameter of the pressure vessel 2 can be reduced by dividing the furnace means 1 into a plurality of the furnaces of the reduced size. This provides:

(1) a reduction in wall thickness of the pressure vessel 2;

(2) a shortening of the time required for inspecting a weld zone of the pressure vessel; and (3) an ability to transport the pressure vessels 2 as modules even in a larger volume boiler as a result of the reduction in weight of the devices within each of the pressure vessels 2, leading to a reduction in installation cost.

In this case, the diameters of all the pressure vessels can be minimized, and the above three merits can be achieved in the best manner by constructing the pressure vessels 2, so that the diameter ratio between the pressure vessel 2 having the largest diameter and the pressure vessel 2 having the smallest diameter is in a range of 1:1 (in this case, all the pressure vessel 2 have the same diameter) to 1:1.2, and selecting the proper size and shape of the furnaces 1 so that they can be accommodated.

What is claimed is:

1. A pressurized fluidized bed boiler comprising furnace means having an evaporator, a superheater, and reheater disposed therein and divided into at least two separate furnaces: a furnace with an evaporator disposed therethrough, and a furnace with a reheater disposed therethrough, at least two pressure vessels which separately accommodate the furnaces, respectively, control means for controlling the temperature of steam in outlets of the superheater and the reheater by varying the level of the fluidized bed in each of the separate furnaces, and air pipes connected to the pressure vessels to introduce a combustion air into the furnaces and a compressed air into the pressure vessels.

2. A pressurized fluidized bed boiler according to claim 1, wherein said furnace means is divided into three or more furnaces, including a furnace with the evaporator being disposed to extend therethrough, and a furnace with the reheater means divided into two or more reheaters being disposed therein to extend therethrough.

3. A pressurized fluidized bed boiler according to claim 1, wherein said superheaters are separately disposed in said furnace with said evaporator disposed therein and in said furnace with said reheater disposed therein.

4. A pressurized fluidized bed boiler according to claim 1, wherein said pressure vessels are sized so that the diameter ratio of the pressure vessel having largest diameter and the vessel having the smallest diameter is in a range of from 1:1 to 1:1.2, and each of the furnaces is sized and shaped so that it can be accommodated in the corresponding pressure vessel.

5. A pressurized fluidized bed boiler comprising furnace means having an evaporator, a superheater, and reheater disposed therein and divided into at least two separate furnaces: a furnace with an evaporator disposed therethrough, and a furnace with a reheater disposed therethrough, at least two pressure vessels which separately accommodate the furnaces, respectively, control means for controlling the temperature of steam in each of outlets of the superheater and the reheater by varying the level of the fluidized bed in each of the separate furnaces, air pipes connected to the pressure vessels to introduce a combustion air into said furnaces and a compressed air into said pressure vessels, respectively, air flow rate adjusting means mounted in said air pipes connected to said pressure vessels for independently controlling the flow rate of air introduced into each of said furnaces, oxygen concentration detecting means mounted in an exhaust gas pipe from each of said furnaces for detecting the concentration of oxygen in an exhaust gas in an outlet of each of said furnaces, fuel supply amount detecting means for detecting the amount of fuel supplied into each of said furnaces, and air-fuel ratio control means for allowing said air flow rate adjusting means to perform an air flow rate control on the basis of a detection value detected by at least one of said oxygen concentration detecting means and said fuel supply amount detecting means.

6. A pressurized fluidized bed boiler according to claim 5, wherein said furnace means is divided into three or more furnaces, including a furnace with the evaporator being disposed to extend therethrough, and a furnace with the reheater means divided into two or more reheaters being disposed therein to extend therethrough.

7. A pressurized fluidized bed boiler according to claim 5, wherein said superheaters are separately disposed in said furnace with said evaporator disposed therein and in said furnace with said reheater disposed therein.

8. A pressurized fluidized bed boiler according to claim 5, wherein said said pressure vessels are sized so that the diameter ratio of the pressure vessel having largest diameter and the vessel having the smallest diameter is in a range of from 1:1 to 1:1.2, and each of the furnaces is sized and shaped so that it can be accommodated in the corresponding pressure vessel.

9. A method for operating a pressurized fluidized bed boiler comprising furnace means having an evaporator, a superheater, and reheater disposed therein and divided into at least two separate furnaces: a furnace with an evaporator disposed therethrough, and a furnace with a reheater disposed therethrough, at least two pressure vessels which separately accommodate the furnaces, respectively, control means for controlling the temperature of steam in outlets of the superheater and the reheater by varying the level of the fluidized bed in each of the separate furnaces, and air pipes connected to the pressure vessels to introduce a combustion air into the furnaces and a compressed air into the pressure vessels, wherein only said furnace having the evaporator disposed therein is started at an initial stage of starting of said boiler, and said furnace having the reheater disposed therein is started only when a condition permitting steam to be sufficiently insured in said reheater has been reached.

10. A method for operating a pressurized fluidized bed boiler comprising furnace means having an evaporator, a superheater, and reheater disposed therein and divided into at least two separate furnaces: a furnace with an evaporator disposed therethrough, and a furnace with a reheater disposed therethrough, at least two pressure vessels which separately accommodate the furnaces, respectively, control means for controlling the temperature of steam in each of outlets of the superheater and the reheater by varying the level of the fluidized bed in each of the separate furnaces, air pipes connected to the pressure vessels to introduce a combustion air into said furnaces and a compressed air into said pressure vessels, respectively, air flow rate adjusting means mounted in said air pipes connected to said pressure vessels for independently controlling the flow rate of air introduced into each of said furnaces, oxygen concentration detecting means mounted in an exhaust gas pipe from each of said furnaces for detecting the concentration of oxygen in an exhaust gas in an outlet of each of said furnaces, fuel supply amount detecting means for detecting the amount of fuel supplied into each of said furnaces, and air-fuel ratio control means for allowing said air flow rate adjusting means to perform an air flow rate control on the basis of a detection value detected by at least one of said oxygen concentration detecting means and said fuel supply amount detecting means, wherein only said furnace having the evaporator disposed therein is started at an initial stage of starting of said boiler, and said furnace having the reheater disposed therein is started only when a condition permitting steam to be sufficiently insured in said reheater has been reached.

* * * * *

UNITED STATES PATENT AND TRADEMARK OFFICE

CERTIFICATE OF CORRECTION

PATENT NO. : 5,476,071
DATED : December 19, 1995
INVENTOR(S) : NISHIYAMA et al

It is certified that error appears in the above-indentified patent and that said Letters Patent is hereby corrected as shown below:

Col. 1, line 37, "[material" should read --material--.

Col. 2, line 42, "all" should read --wall--.

Col. 5, line 28, "rill" should read --will--.

Col. 6, line 15, "team" should read --steam--.

Signed and Sealed this

Eighth Day of October, 1996

*Attest:*

Bruce Lehman

BRUCE LEHMAN

*Attesting Officer*

*Commissioner of Patents and Trademarks*